US006566287B1

(12) United States Patent
Mimura et al.

(10) Patent No.: US 6,566,287 B1
(45) Date of Patent: May 20, 2003

(54) NON-WOVEN FABRIC, AND SHEET AND ARTIFICIAL LEATHER PRODUCED FROM THE SAME

(75) Inventors: Masahisa Mimura, Ooda (JP); Hideki Nitta, Mihara (JP); Nobuo Ohkawa, Mihara (JP); Kimio Nakamura, Kako-gun (JP); Yoshiji Usui, Kako-gun (JP); Hiroji Wakisaka, Kako-gun (JP); Akihiro Imoto, Kako-gun (JP)

(73) Assignees: Teijin Limited, Osaka (JP); Daiwabo Co., Ltd., Osaka (JP)

( * ) Notice: Subject to any disclaimer, the term of this patent is extended or adjusted under 35 U.S.C. 154(b) by 0 days.

(21) Appl. No.: 09/530,426

(22) PCT Filed: Oct. 29, 1998

(86) PCT No.: PCT/JP98/04911

§ 371 (c)(1),
(2), (4) Date: May 1, 2000

(87) PCT Pub. No.: WO99/23289

PCT Pub. Date: May 14, 1999

(30) Foreign Application Priority Data

Oct. 31, 1997 (JP) ..... 9-314555

(51) Int. Cl.[7] ..... D04H 1/00; D04H 13/00; B32B 27/02

(52) U.S. Cl. ..... 442/351; 442/60; 442/104; 442/168; 442/340; 442/341; 442/408; 428/151; 428/904

(58) Field of Search ..... 428/151, 904; 442/60, 164, 168, 334, 340, 341, 351, 104, 408

(56) References Cited

U.S. PATENT DOCUMENTS

| | | | | |
|---|---|---|---|---|
| 3,962,512 A | * | 6/1976 | Fontana et al. | 427/366 |
| 4,073,988 A | | 2/1978 | Nishida et al. | |
| 4,107,374 A | | 8/1978 | Kusunose et al. | |
| 4,233,349 A | | 11/1980 | Niederhauser | |
| 4,342,801 A | | 8/1982 | Gerlach et al. | |
| 4,612,688 A | * | 9/1986 | Gerlach et al. | 28/104 |

FOREIGN PATENT DOCUMENTS

| | | | |
|---|---|---|---|
| GB | 2 065 732 A | * | 12/1980 |
| JP | 48-22126 | | 7/1973 |
| JP | 48-27443 | | 8/1973 |
| JP | 49-26581 | | 3/1974 |
| JP | 49-93663 | | 9/1974 |
| JP | 49-132377 | | 12/1974 |
| JP | 51-58578 | | 5/1976 |
| JP | 54-96181 | | 7/1979 |
| JP | 57-171757 | | 10/1982 |
| JP | 4-65567 | | 3/1992 |

OTHER PUBLICATIONS

Database WPI; Section Ch, Week 199132; Derwent Publication Ltd., London, GB; Class A23, AN 1991–235578 XP002223175 & KR 9 005 002 B (Kolon CO), Jul. 16, 1990 (Jul. 16, 1990) Abstract.

* cited by examiner

*Primary Examiner*—Terrel Morris
*Assistant Examiner*—Jenna-Leigh Befumo
(74) *Attorney, Agent, or Firm*—Sughrue Mion, PLLC

(57) ABSTRACT

A non-woven fabric having such a structure that fine fibers having a small fineness are entangled with one another and a sheet obtained by impregnating the non-woven fabric with an elastic polymer satisfy the following requirements:

the fine fibers should be obtained by splitting a strippable and splittable composite short fiber comprising at least two components; the fine fibers should have a monofilament size of 0.01 to 0.5 denier; the fine fibers should form a fine non-woven fabric structure that they are entangled with one another at random; the apparent density should be 0.18 to 0.45 g/cm$^3$; the average area of spaces between fibers in the cross section of the non-woven fabric measured by the image analysis of an electron scanning microscope should be 70 to 250 $\mu$m$^2$; and the non-woven fabric should have such a uniform structure that the standard deviation of the area of a space between fibers in the cross section of the non-woven fabric measured by the image analysis of the electron scanning microscope is 200 to 600 $\mu$m$^2$.

The non-woven fabric and sheet are advantageously used as a substrate for artificial leather.

14 Claims, No Drawings

NON-WOVEN FABRIC, AND SHEET AND ARTIFICIAL LEATHER PRODUCED FROM THE SAME

DETAILED DESCRIPTION OF THE INVENTION

The present invention relates to a non-woven fabric for artificial leather and to artificial leather produced from the same and, more specifically, to a non-woven fabric formed of fine fibers obtained from a strippable and splittable composite short fiber comprising at least two components and to artificial leather produced from the same.

PRIOR ART

In recent years, artificial leather which is a natural leather substitute has been widely used in the fields of garments, general materials and sports because its characteristic features such as lightweight and easy care have been recognized by consumers. However, artificial leather having improved softness which is the characteristic feature of natural leather and drapeability derived from a fine structure has been demanded from the market and various proposals have been made.

For example, there is proposed a process in which the fineness of a fiber forming a non-woven fabric is reduced to 0.3 denier or less. Artificial leather produced from this fiber is actually produced and marketed. When a non-woven fabric formed of fibers of 0.3 denier or less (to be referred to as "non-woven microfabric" hereinafter) is obtained simply by reducing the monofilament size of the fibers, neps or the like are formed in the carding step with the result of a reduction in process efficiency. Therefore, various processes which improve this are proposed. These conventional production processes are roughly divided into the following three groups.

As disclosed by JP-B 48-22126 (the term "JP-B" as used herein means an "examined Japanese patent publication"), the first group uses a sea-island type composite short fiber having such a cross section that a sea and many islands are formed from a sea component and an island component incompatible with the sea component by the shapes of spinning nozzles, respectively. In this process, a non-woven fabric is produced by carrying out a mechanical entangling treatment such as needle punching or contact with a jet liquid flow after the conventional production process of a non-woven fabric. Thereafter, the non-woven fabric is impregnated with an elastic polymer, or a non-woven microfabric is formed by dissolving and removing the sea component with a solvent which dissolves the sea component but not the island component before impregnation, and an artificial leather substrate is produced using this non-woven fabric as a base.

As disclosed by JP-B 48-27443, the second group uses a polymers-blended sea-island type composite short fiber obtained by mixing a sea component for forming the sea and an island component for forming islands incompatible with the sea component in the cross section of the fiber in a molten state and spinning a dispersion containing the island component dispersed in the sea component. Also in this process, like the above sea-island type composite short fiber, after a non-woven fabric is formed, the sea component is dissolved and removed with a solvent which dissolves the sea component but not the island component to produce a non-woven microfabric, and an artificial leather substrate is produced using this non-woven fabric as a base.

As disclosed by JP-A 4-65567 (the term "JP-A" as used herein means an "unexamined published Japanese patent application"), the third group uses a strippable and splittable composite short fiber having such a cross section that two different components incompatible with each other are arranged alternately several times (as side-by-side type). In this process, the strippable and splittable composite short fiber is stripped and split into fine fibers while they are mechanically entangled by contact with a jet liquid flow or the like to produce a non-woven microfabric. Thereafter, the non-woven microfabric is impregnated with an elastic polymer to produce an artificial leather substrate comprising the non-woven microfabric as a base.

As disclosed by JP-A 49-26581, 49-93663, 49-132377 and 54-96181, there is still another process in which heat shrinkability is provided to a polyester-based resin component to facilitate the stripping and splitting of a strippable and splittable composite short fiber comprising a polyamide component and a polyester-based resin component.

Suede type and nubuck type artificial leathers produced from non-woven microfabrics formed of these fibers are very soft and have a good appearance making use of the small monofilament sizes of the fibers. However, when a grain type artificial leather is produced by forming a film of an elastic polymer on the surface, it is not satisfactory because it is not so tight as natural leather and is greatly wrinkled when its surface is bent inward. The reason for this is that even when single fiber having a small fineness is formed by splitting parent fiber, it is entangled in the state of a large assembly because the fineness of the parent fiber for forming the single fiber having a small fineness is 3 to 10 denier with the result of the formation of spaces of the same size as spaces formed in a non-woven fabric formed by entangling single fiber having a large fineness of the prior art.

As described above, since the beauty of artificial leather, mainly suede type artificial leather comprising a non-woven microfabric as a base, has gained wide acceptance from consumers, great progress is being made. A grain type artificial leather has softness even when a non-woven microfabric is used and a grain layer is formed on the surface, but it lacks tightness and is easily wrinkled by bending. When it is formed into a shoe, trunk, glove or furniture, or it is used or worn, it is difficult to obtain an aesthetic appearance and the improvement of the appearance has been strongly desired from the market.

MEANS FOR SOLVING THE PROBLEM

The present inventors paid attention to the fact that the cause of bending wrinkles is the structure of a non-woven fabric formed by entangling the above assembly of fibers having a small fineness and began to study how a fiber entangled state is finely and uniformly formed in the structure of a non-woven fabric formed by entangling fibers having a small fineness and the characteristic properties of the non-woven fabric when formed. A first possible means is to use a short fiber having a small fineness. However, with this means, neps are formed in the carding step because the fiber is very fine, thereby reducing process efficiency. Therefore, the means was excluded from the list of study.

After a process for producing a non-woven microfabric from a composite short fiber from which fibers having a small fineness can be formed was studied, in consideration of the facts that a process for dissolving and removing a sea component from a sea-island type composite short fiber and a polymers-blended sea-island type composite short fiber is required and that there is the loss of a raw material which is dissolved and removed, a non-woven microfabric having an entangled structure of fibers having a small fineness formed from a strippable and splittable composite short fiber which is economically advantageous has been studied. A non-woven fabric obtained from a conventional strippable and splittable composite short fiber by a jet liquid flow contact entangling method cannot have a uniform and fine structure but a structure that stripped and split fibers having a small fineness are mostly entangled in the state of a large assembly. In the above process which uses a strippable and splittable composite short fiber comprising a heat shrinkable polyester component, the shrinkage energy of the polyester component is consumed at the time of stripping and splitting and an assembly of fibers having a small fineness is not broken because the process is aimed to facilitate stripping making use of the axial shrinkage force of the polyester component at the time of stripping and splitting. As a result, a uniform and fine structure cannot be obtained.

It is therefore a first object of the present invention to provide a non-woven fabric having such a structure that fibers having a small fineness formed from a strippable and splittable composite short fiber are entangled with one another as uniformly and finely as possible by making the proportion of fiber assemblies as small as possible, and a production process for the same.

It is a second object of the present invention to provide a non-woven fabric having such a structure that fibers having a small fineness formed from a strippable and splittable composite short fiber are finely and uniformly entangled with one another and hence, spaces between fibers are small on the average and the distribution of the spaces is relatively small, and a production process for the same.

It is a third object of the present invention to provide a sheet for artificial leather which is very soft and tight and has a fine structure that it is rarely wrinkled by bending, and a production process for the same.

It is a fourth object of the present invention to provide a process for producing the above non-woven fabric and sheet industrially advantageously.

MEANS FOR SOLVING THE PROBLEM

It has been found from studies conducted by the present inventors that the above objects of the present invention are attained by the following non-woven fabric.

That is, according to the present invention, there is provided a non-woven fabric formed of fine fibers which satisfies the following requirements:

(i) the fine fibers should be obtained by splitting a strippable and splittable composite short fiber comprising at least two resin components which are incompatible with each other;

(ii) the fine fibers should have a monofilament size of 0.01 to 0.5 denier;

(iii) the fine fibers should form a fine non-woven fabric structure that they are entangled with one another at random;

(iv) the apparent density should be 0.18 to 0.45 g/cm$^3$;

(v) the average area of spaces between fibers in the cross section of the non-woven fabric measured by the image analysis of an electron scanning microscope should be 70 to 250 $\mu$m$^2$; and (vi) the non-woven fabric should have such a uniform structure that the standard deviation of the area of a space between fibers in the cross section of the non-woven fabric measured by the image analysis of the electron scanning microscope is 200 to 600 $\mu$m$^2$.

It has also been found from studies conducted by the present inventors that the non-woven fabric of the present invention can be obtained by the following production process.

That is, according to the present invention, there is provided a process for producing a non-woven fabric which comprises the steps of:

(1) forming card webs from a strippable and splittable composite short fiber comprising at least two resin components which are incompatible with each other and at least one of which is heat shrinkable and layering together the card webs (layering step);

(2) entangling and stripping/splitting the obtained layered web to split the composite short fiber into fine fibers having a monofilament size of 0.01 to 0.5 denier and entangle the fine fibers with one another so as to produce an unshrunk non-woven fabric (entangling and splitting step); and (3) heating the obtained unshrunk non-woven fabric to thermally shrink heat shrinkable fine fibers contained in the fine fibers to reduce the area of the non-woven fabric by 10 to 50% (shrinking step).

The present invention will be described in detail hereinunder.

At least two components forming the strippable and splittable composite short fiber of the present invention have fiber formability and may be any combination of synthetic resins if they are not compatible with each other. However, in consideration of process control and productivity in the production of a strippable and splittable composite short fiber, polyester-based resins and polyamide-based resins which allow for melt spinning can be advantageously used.

That is, the synthetic resins used to produce the strippable and splittable composite short fiber of the present invention are not particularly limited if they are two incompatible components selected from fiber forming polyester-based resins and fiber forming polyamide-based resins. The polyester-based resins include polyethylene terephthalate, polybutylene terephthalate and the like, and the polyamide-based resins include nylon-6, nylon-66, nylon-12 and the like. Out of these, a combination of polyethylene terephthalate and nylon-6 is preferred from the viewpoint of process efficiency and cost.

The strippable and splittable composite short fiber may comprise three components including a polyester copolymer resin containing a metal salt sulfonate as another polyester-based resin component.

The strippable and splittable composite short fiber of the present invention has such a structure that at least one of the constituent components is split into two or more parts and at least part of each constituent component is exposed to the surface of the fiber in the cross section of the fiber. The number of split parts is not-particularly limited but preferably 8 to 24 in consideration of process efficiency and strippability/splittability. The proportion of one component of the strippable and splittable composite short fiber of the present invention is preferably 30 to 70 wt %, particularly preferably 40 to 60 wt % based on the total from the viewpoint of the splittability and spinnability of the fiber. Above this range, it is difficult to control the balance of the viscosity of the resin, which might cause a section failure and reduce the splitting rate.

The strippable and splittable composite short fiber of the present invention is preferably a composite fiber comprising a polyester component and a polyamide component, wherein heat shrinkage ratio of said polyester component is 10% or more larger than that of the polyamide component. The present invention is characterized in that a non-woven fabric in which fine fibers obtained after stripping and splitting are entangled with one another into a fiber assembly in the prior art is made uniform and fine by thermally shrinking after stripping and splitting to provide freedom between a polyester fiber and a polyamide fiber having small shrinkage through the shrinkage of the polyester fiber arranged alternately to alleviate the assembly of fibers and by thermally shrinking the whole non-woven fabric. Therefore, the difference of heat shrinkage ratio between the polyester component and the polyamide component must be 10% or more. When the difference is smaller than 10%, the effect of the present invention cannot be obtained.

The above difference of heat shrinkage ratio between the components of the strippable and splittable composite short fiber of the present invention can be obtained by controlling the spinning temperature, take-up rate, drawing temperature and draw ratio. The spinning temperature is suitably determined in consideration of balance between the viscosities of the both components. There is a tendency that when spinning is carried out at low temperatures, fibers having a large difference of heat shrinkage ratio are obtained. The take-up rate of filaments is preferably 2,000 m/min or less. When the take-up rate is higher than 2,000 m/min, the crystalization by orientating a fiber proceeds and a sufficiently large difference of heat shrinkage ratio may not be obtained.

The stripped and split fibers of the present invention have a fineness of 0.01 to 0.5 denier. When the fineness is smaller than 0.01 denier, the fibers adhere to each other after stripping and splitting because the fibers are too fine, thereby making it difficult to impregnate an elastic polymer, which is not preferred for the production of artificial leather. When the fineness is larger than 0.5 denier, a non-woven fabric having a uniform and fine structure which the present invention is directed to cannot be obtained because the fibers are too thick. The fineness of a filament (parent fiber) forming the fibers having the above fineness which is determined by the number of split parts, fineness after stripping and splitting and draw ratio is preferably 1 to 10 denier. When the fineness of the filament is smaller than 1 denier, end breakage readily occurs at the time of spinning, resulting in a reduction in productivity. When the fineness is larger than 10 denier, the fineness of a product becomes large and the obtained non-woven fabric hardly has a uniform and fine structure which the present invention is directed to even when the strippable and splittable composite short fiber is split.

There is a tendency that fibers having a larger difference of heat shrinkage ratio are obtained as the drawing temperature becomes lower. The difference of heat shrinkage ratio becomes larger as the draw ratio decreases. When the drawing temperature and the draw ratio are increased, the crystalization by orientating the fibers is promoted and the targeted difference of heat shrinkage ratio is not obtained. Especially in the present invention, the drawing temperature is preferably 40 to 60° C. and the draw ratio is preferably 1.0 to 3.0 times. When the drawing temperature is lower than 40° C., the fiber strength becomes weak and the card passability deteriorates, and when the drawing temperature is higher than 60° C., a sufficiently large difference of heat shrinkage ratio is hardly obtained. When the draw ratio is smaller than 1.0 time, satisfactory fiber characteristic properties are not obtained and when the draw ratio is larger than 3.0 times, a sufficiently large difference of heat shrinkage ratio is hardly obtained. The draw ratio is more preferably 1.2 to 2.5 times.

A lubricant or the like is applied to the surface of the strippable and splittable composite fiber thus obtained, and the fiber is crimped, dried and cut to a predetermined length by a cutter or, the like. Drying is generally carried out with hot air or the like. As the drying temperature becomes lower, fibers having a larger difference of heat shrinkage ratio are apt to be obtained. The drying temperature is preferably 70° C. or less, more preferably 40 to 60° C. When the drying temperature is higher than 70° C., the targeted difference of heat shrinkage ratio is not obtained and when the drying temperature is lower than 40° C., the drying efficiency is low, which is not practical from the viewpoint of productivity and cost. The length of each fiber is preferably 30 to 100 mm, more preferably 40 to 70 mm in consideration of card passability. When the length of the fiber is larger than 100 mm, the card passability of the fiber deteriorates and when the length is smaller than 30 mm, it becomes difficult to card the fiber.

The strippable and splittable composite short fiber thus obtained is opened with an ordinary roller card to form a web. At this point, other short fiber may be blended. However, to attain the object of the present invention, the proportion of the other short fiber to be blended is preferably less than 40 wt %. More preferably, a short fiber substantially formed from the strippable and splittable composite short fiber of the present invention is formed into a web. When the proportion of the other short fiber to be blended is 40 wt % or more, it may be difficult to obtain a non-woven fabric having a uniform and fine structure which the present invention is directed to.

The other fiber to be blended is not particularly limited but at least one may be selected from regenerated fibers of rayon and the like, semi-synthetic fibers of acetate and the like, natural fibers of wool and the like, polyamide fibers such as nylon-6 and nylon-66 fibers, polyester-based fibers such as polyethylene terephthalate and polybutylene terephthalate fibers, and polyolefin-based fibers such as polyethylene and polypropylene fibers and used. As a matter of course, the shape of each fiber is not limited and a core-sheath composite fiber formed from a combination of the above thermoplastic resins, strippable and splittable composite short fiber, short fiber having a modified cross section and the like may be used.

The card webs obtained as described above are layered together to a target weight with a cross layer or the like to produce a layered web which is then subjected to a mechanical entangling treatment. The entangling treatment of the layered web is carried out by a conventionally known method per se for entangling fibers by punching with barbed needles or by contact with a jet liquid flow. Since the strippable and splittable composite short fiber must be entangled three-dimensionally and treated so that it can be stripped and split, it is the most effective to carry out a jet liquid flow contact entangling treatment after needle punching. For example, to obtain a non-woven fabric having a weight of 150 g/m$^2$, sharped water may be sprayed onto the front and rear sides of a non-woven fabric at a water pressure of 50 to 200 kg/cm$^2$ from a nozzle having orifices with a hole diameter of 0.05 to 0.5 mm at intervals of 0.5 to 1.5 mm one time to four times each. When this jet liquid flow contact treatment is carried out, the non-woven fabric may be dried at a temperature that its shrinkage performance remains in hot water heated at 50° C. or more.

The unshrunk non-woven fabric thus entangled and stripped/split is shrunk by heating. By heating the non-woven fabric obtained by entangling an assembly of stripped and split fibers having a small fineness, the form of the assembly is broken and randomized because a polyester fiber forming the assembly has a larger shrinkage ratio than that of a polyamide fiber and shrinkage occurs in the plane direction, thereby increasing density. Thus, by heating a conventional non-woven microfabric formed by entangling an assembly of fibers having a small fineness, one component forming the assembly and arranged alternately thermally shrinks and breaks the structure of the assembly with the result of the formation of a fine structure that the fibers having a small fineness are entangled with one another at random, thereby making uniform the whole structure and increasing density. As a result, compared with the conventional non-woven microfabric, the volume of a space between fibers formed by entangling fibers is fined. That is, the volume of the space formed between the fibers becomes smaller and the number of the spaces becomes larger than those of the conventional non-woven microfabric, thereby making the whole structure uniform and fine.

Heating for shrinking the unshrunk non-woven fabric may be either wet heating or dry heating but the unshrunk non-woven fabric is preferably shrunk in hot water. When the unshrunk non-woven fabric is shrunk in hot water, it is shrunk while its tension is alleviated by its buoyancy, thereby making it easy to form a non-woven fabric structure of interest effectively. Therefore, the temperature of the hot water is preferably 65 to 90° C., more preferably 67 to 72° C. When the heating temperature is lower than 65° C., heat shrinkage becomes insufficient and when the heating temperature is higher than 80° C., the shrinking speed becomes fast, thereby making it difficult to realize uniform heat shrinkage.

The area of the non-woven fabric is shrunk by the heat shrinkage of the polyester fiber, thereby increasing the density. When the area shrinkage ratio at this point is obtained from {(area before shrinkage−area after shrinkage)/(area before shrinkage)}×100 (%), it is preferably 10 to 50%, more preferably 15 to 40%. When the area shrinkage ratio is smaller than 10%, the non-woven fabric having a fine and uniform structure of the present invention cannot be obtained. When the area shrinkage ratio is larger than 50%, the non-woven fabric is wrinkled at the time of heat shrinkage and the space between fibers becomes too small, that is, the apparent density becomes higher than required. As a result, a non-woven fabric which is tight but inferior in drapeability is obtained disadvantageously.

As the area shrinkage ratio becomes larger, a non-woven fabric having a higher apparent density is obtained. The apparent density of the non-woven fabric of the present invention is preferably 0.18 to 0.45 g/cm$^3$, more preferably 0.25 to 0.40 g/cm$^3$. To develop the uniform non-woven fabric structure of the present invention by heat shrinkage, the lower limit of apparent density is 0.18 g/cm$^3$. A non-woven fabric having an apparent density of more than 0.45 g/cm$^3$ is tight but inferior in drapeability as described above.

The area shrinkage and the apparent density can be easily controlled with the heat shrinkage ratio, blend ratio and entangling degree of the polyester component of the strippable and splittable composite short fiber of the present invention or the heating temperature of the shrinking step.

The non-woven fabric of the present invention obtained as described above has such a structure that fibers are uniformly and finely entangled with one another. The average area of spaces between fibers in the cross section in a direction perpendicular to the surface of the non-woven fabric measured by the image analysis of an electron scanning microscope is 70 to 250 $\mu$m$^2$, preferably 100 to 230 $\mu$m$^2$. The standard deviation at this point is 200 to 600 $\mu$m$^2$, preferably 250 to 500 $\mu$m . When the average area is smaller than 70 $\mu$m a non-woven fabric having high density and a fine and uniform structure which cannot be obtained in the prior art is obtained but the non-woven fabric is tight but inferior in drapeability as described above. When the average area is larger than 250 $\mu$m$^2$ and a grain layer is formed on the surface of the non-woven fabric to produce artificial leather, the obtained leather is not tight and is easily wrinkled by bending like the leather by use of the prior art non-woven fabric though it looks uniform at first sight.

The value of standard deviation indicating uniformity is preferably smaller. When it is larger than 600 $\mu$m$^2$, large spaces are scattered even if the average value falls within the range of the present invention and a non-woven fabric which is easily wrinkled by bending is obtained disadvantageously.

The average area of spaces between fibers in the cross section in a direction perpendicular to the surface of the non-woven fabric of the present invention is measured by the following method of analyzing an image obtained by an electron scanning microscope.

(1) Formation of Sample;

A gold film is formed on a sectional sample of a non-woven fabric to be measured to a thickness of 800 Å by ion sputtering at a pressure of up to $10^{-1}$ Pa using the JFC-1500 ion sputtering device of JEOL Ltd.

(2) Photographing with Electron Microscope;

The waveform of an image signal for the sample formed in (1) above is displayed on a CRT for observation at an acceleration voltage of 5 kV, a filament current of 2.2 A and a scanning speed of 15.7 sec/line (horizontal, 60 Hz) using the JSM-6100 electron scanning microscope of JEOL Ltd. to determine exposure by aligning the peak and the lowest level of the waveform with 5 V and 0 V of a potential scale and turning off a waveform monitor. The magnification is then set at 200X.

(3) Image Processing;

An image is input (automatically) from an electron scanning microscope using the IP-1000PC high-definition image analytical system of Asahi Chemical Industry Co., Ltd. and the image processing of "aperture measurement" is selected for measurement. The binary threshold value of this image processing is ½ of the maximum value of a brightness distribution. The average area of spaces between fibers in the cross sections of the non-woven fabric and substrate for artificial leather of the present invention is measured by the method described above.

In the above measurements (1) to (3), other devices having the same functions and performance as the ion sputtering device, the electron scanning microscope and the image analyzer may be used.

The obtained non-woven fabric itself is suitably used for artificial leather as well as for other applications such as garments, interior finishes, interior materials, wipers such as industrial wipers and wiping cloth, and filters such as bag filters and filtration cloth.

The above non-woven fabric of the present invention is impregnated with an elastic polymer to produce a sheet which is very soft and tight and has great value as a base fabric for artificial leather.

According to studies conducted by the present inventors, there is provided the following sheet which is produced from the above non-woven fabric and useful as a base fabric for artificial leather. That is, according to the present invention, there is provided a sheet obtained by impregnating a non-woven fabric formed of fine fibers with an elastic polymer, which satisfies the following requirements:

(i) the fine fibers should be obtained by splitting a strippable and splittable composite short fiber comprising at least two resin components which are incompatible with each other;

(ii) the fine fibers should have a monofilament size of 0.01 to 0.5 denier;

(iii) the fine fibers should form a fine non-woven fabric structure that they are entangled with one another at random;

(iv) the sheet should have a weight ratio of the non-woven fabric to the elastic polymer of 97:3 to 50:50;

(v) the sheet should have an apparent density of 0.20 to 0.60 g/cm$^3$;

(vi) the sheet should have an average area of spaces between fibers in the cross section of the non-woven fabric impregnated with the elastic polymer measured by the image analysis of an electron scanning microscope of 70 to 120 $\mu$m$^2$; and (vii) the sheet should have such a uniform structure that the standard deviation of the area of a space between fibers in the cross section of the non-woven fabric impregnated with the elastic polymer measured by the image analysis of the electron scanning microscope is 50 to 250 $\mu$m$^2$.

It has been found from studies conducted by the present inventors that the sheet is produced by the following sheet production processes (I) and (II) industrially advantageously.

Sheet Production Process (I):

A sheet production process comprising the following steps:

(1) forming card webs from a strippable and splittable composite short fiber comprising at least two resin components which are incompatible with each other and at least one component of which is heat shrinkable and layering the card webs (layering step);

(2) entangling and stripping/splitting the obtained layered web to split the composite short fiber into fine fibers having a monofilament size of 0.01 to 0.5 denier and entangle the fine fibers with one another so as to produce an unshrunk non-woven fabric (entangling and splitting step);

(3) heating the obtained unshrunk non-woven fabric to shrink the heat shrinkable fine fibers contained in the fine fibers to reduce the area of the non-woven fabric by 10 to 50% (shrinking step); and (4) impregnating the obtained non-woven fabric with an elastic polymer (impregnation step).

Sheet Production Process (II):

A sheet production process comprising the following steps:

(1) forming card webs from a strippable and splittable composite short fiber comprising at least two resin components which are incompatible with each other and at least one component of which is heat shrinkable and layering the card webs (layering step);

(2) entangling and stripping/splitting the obtained layered web to split the composite short fiber into fine fibers having a monofilament size of 0.01 to 0.5 denier and entangle the fine fibers with one another so as to produce an unshrunk non-woven fabric (entangling and splitting step);

(3) impregnating the obtained non-woven fabric with an elastic polymer (impregnation step); and (4) heating the obtained unshrunk sheet to shrink the heat shrinkable fine fibers contained in the fine fibers to reduce the area of the non-woven fabric by 10 to 50% (shrinking step).

The above sheet production processes (I) and (II) differ from each other in that the unshrunk non-woven fabric is heated and then impregnated with an elastic polymer in the former process whereas the unshrunk non-woven fabric is impregnated with an elastic polymer and then shrunk by heating in the latter process. The sheet of the present invention is obtained by any one of the processes but the former process is preferred because a structure having finer and more uniform spaces between fibers is obtained.

The sheet and its production process of the present invention will be described in more detail hereinunder.

The elastic polymer to be impregnated into the non-woven fabric (or unshrunk non-woven fabric) of the present invention may be an elastic polymer which is generally used for artificial leather. That is, illustrative examples of the elastic polymer include synthetic resins such as polyvinyl chloride, polyamides, polyesters, polyester-ether copolymers, polyacrylic acid ester copolymers, polyurethanes, neoprene, styrene-butadiene copolymers, silicone resins, polyamino acids and polyamino acid polyurethane copolymers, natural polymer resins, and mixtures thereof. A pigment, dye, crosslinking agent, filler, plasticizer and various stabilizers may be further added as required. A polyurethane or a blend of a polyurethane and other resin is preferably used because a soft feel is obtained.

The above elastic polymer is impregnated into the non-woven fabric of the present invention as an organic solvent solution, dispersion, aqueous solution or water dispersion. To coagulate the elastic polymer, conventionally known processes may be employed. The conventionally known processes include, for example, a drying process, preferably a heat sensitive coagulation process, more preferably a multiple-aperture coagulation process in which a W/O type emulsion is dried. There is also a wet process in which an elastic polymer is multiple-aperture coagulated from an organic solvent having compatibility with water in a coagulation bath essentially composed of water. Any one of the conventionally known processes may be employed.

The amount of the elastic polymer to be impregnated can be easily controlled by adjusting the concentration of the elastic polymer in an impregnation solution and the wet pick-up of the impregnation solution at the time of impregnation. In the present invention, the weight ratio of the non-woven fabric to the elastic polymer is 97:3 to 50:50, preferably 95:5 to 60:40. When the proportion of the elastic polymer is smaller than 3 wt %, a soft sheet is easily obtained but a sheet which is tight and has adhesion strength when an elastic polymer film is formed on the surface to produce a grain type artificial leather is hardly obtained. When the proportion is larger than 50 wt %, the obtained sheet has the strong properties of the elastic polymer and high rubber elasticity and hence, is not suitable as a sheet for artificial leather.

A very tight sheet can be obtained from the non-woven fabric of the present invention even when the amount of the elastic polymer impregnated is small because fibers are finely and uniformly entangled with one another. The impregnated non-woven fabric sheet of the present invention has an apparent density of 0.20 to 0.60 g/cm$^3$, preferably 0.25 to 0.55 g/cm$^3$. The apparent density of the impregnated non-woven fabric (sheet) is determined by the apparent density of a non-woven fabric used and the amount of an elastic polymer impregnated. When the apparent density is lower than 0.20 g/cm$^3$, the uniform structure of the present invention is hardly obtained, high tightness is not felt, and required strength is hardly obtained. Therefore, the obtained sheet is not suitable as a substrate for artificial leather. When the apparent density is higher than 0.60 g/cm$^3$, high tightness is easily obtained but softness and drapeability are hardly obtained.

The impregnated non-woven fabric (sheet) of the present invention is fine and uniform. These characteristic properties are measured by the image analysis of an electron scanning microscope like a non-woven fabric. That is, the average area of spaces formed by the fibers and the elastic polymer in the cross section in a direction perpendicular to the surface of the impregnated non-woven fabric (sheet) of the present invention is 70 to 120 $\mu$m$^2$, preferably 80 to 110 $\mu$m$^2$ and the standard deviation at this point is 50 to 250 $\mu$m$^2$, preferably 70 to 200 $\mu$m$^2$. When the average area of the spaces is larger than 120 $\mu$m$^2$, the sheet does not become sufficiently fine and the obtained artificial leather is easily wrinkled by bending. When the average area of the spaces is smaller than 70 $\mu$m$^2$, the sheet becomes too fine and very tight but hardly obtains softness and drapeability. The value of standard deviation indicating uniformity is preferably small. When the standard deviation is larger than 250 $\mu$m$^2$, this means that large spaces are scattered even when the value of average area falls within the range of the present invention. In this case, the obtained artificial leather is easily wrinkled by bending.

The sheet of the present invention has a thickness of 0.3 to 3.0 mm, preferably 0.5 to 2.0 mm.

As for processes for producing the above sheet, the production process (I) which comprises producing a shrunk non-woven fabric by heating an unshrunk non-woven fabric and impregnating the fabric with an elastic polymer has been mainly described. The production process (II) can be also employed without changing the basic conditions and means of each step. That is, in the production process (II), the unshrunk non-woven fabric obtained in the same manner as in the production process (I) is impregnated with an elastic polymer and then the obtained impregnated unshrunk sheet is shrunk by heating. In this production process (II), the heat shrinkage of the heat shrinkable fine fiber is carried out by the procedure and conditions of the production process (I) (procedure and conditions explained in the non-woven fabric production process). However, since heating is carried out after the impregnation of the elastic polymer in the production process (II), in consideration of the fact that the elastic polymer is already impregnated into the spaces between fibers, the heat shrinkage of the heat shrinkable fine fiber and the formation of the fine and uniform spaces between fibers occur as a matter of course but occur less markedly than in the production process (I). Therefore, the results of the analysis of an electron scanning microscope image of the sheet obtained by the production process (II) show that the average area of the spaces is shifted to a slightly higher level in the range of 70 to 120 $\mu$m$^2$ and the standard deviation is shifted to a slightly higher level in the range of 50 to 250 $\mu$m$^2$.

The sheet produced by any one of the above production processes of the present invention is advantageously used as a substrate for artificial leather. When the surface of the sheet is directly raised, a suede type or nubuck type artificial leather can be obtained. At this point, the value of this sheet can be further enhanced by dying. Further, a grain type artificial leather can be obtained by forming an elastic polymer film on the surface. Conventional grain type artificial leathers are easily wrinkled by bending because their impregnated non-woven fabric as a substrate does not have a fine and uniform structure. Therefore, bending wrinkles are formed by rubbing in advance or an elastic polymer layer formed on the surface is made thicker than required to make up for the above defect. In contrast to this, artificial leather comprising the sheet of the present invention as a substrate is hardly wrinkled by bending, tight and soft, and has drapeability irrespective of the thickness of an elastic polymer film formed on the surface as a grain layer.

To form the elastic polymer film on the surface as a grain layer, conventionally known methods are employed. Typical methods include a lamination method in which an elastic polymer film is formed on release paper and bonded to the surface of an impregnated non-woven fabric with an adhesive, one in which a grain layer is formed by coating a W/O type emulsion of an elastic polymer on the surface of an impregnated non-woven fabric, drying the coating film to form a porous layer, and embossing or gravure coating, one in which a film is formed on the surface of the porous layer by lamination, one in which a grain layer is formed by embossing or gravure coating a porous layer formed by a wet process in which a water-compatible organic solvent solution of an elastic polymer is coated on the surface of an impregnated non-woven fabric and multiple-aperture coagulated in a coagulation bath essentially composed of water, and one in which a film is formed on the surface of the porous layer by lamination.

The artificial leather of the present invention obtained as described above can be favorably used in a wide variety of application fields such as upper materials and auxiliary materials for sports shoes, balls such as soccer, basket and volley balls, bags such as trunks, handbags and attache cases, sheets for couches, chair linings and cars, gloves such as golf gloves, baseball gloves and ski gloves, and garments after its softness, surface pattern, color and luster are adjusted. Since the artificial leather of the present invention has softness and excellent physical strength and is light in weight and hardly wrinkled by bending, it has great value as an upper material for shoes, especially as an upper material for sports shoes. Further, it can be advantageously used for balls, furniture sheets, car sheets, garments, gloves and pouches such as trunks and bags.

EXAMPLES

The following examples are provided for the purpose of further illustrating the present invention but are in no way to be taken as limiting. The "parts" and "%" in the examples and comparative examples are based on weight unless otherwise stated. The hot water shrinkage ratio, thickness, tensile strength, breaking elongation, flexural resistance, compressive stress and leather likeness of the raw stock were measured by the following methods.

(1) Hot Water Shrinkage Ratio of Raw Stock

After stretching, 20 cm of a crimped tow obtained by mechanical crimping is collected and a center portion of the tow is marked at two positions which are 10 cm apart from each other while it is elongated by hanging a weight so that a load of 1 mg is applied to the tow per 1 denier. After marking, the load is removed, the tow is immersed in 70° C. hot water for 30 minutes, the water content of the tow after immersion is removed by drying with air at room temperature, the above load is applied to the two again, and the distance between the two marks is measured to obtain the ratio of the distances between the marks before and after shrinkage.

(2) Thickness

The thickness of a sample is measured with a thickness meter (manufactured by Daiei Kagaku Seiki Seisakusho Co., Ltd., trade name: PEACOCK model H) under a load of 180 g per 1 $cm^3$ of the sample.

(3) Tensile Strength and Breaking Elongation

A sample piece measuring 5 cm in width and 15 cm in length is held at a grasp interval of 10 cm and extended at a pulling rate of 30 cm/min with a constant speed extension tensile tester in accordance with the method of JIS L-1096. The values of load and extension at break are taken as tensile strength and breaking elongation, respectively.

(4) Flexural Resistance

A sample piece measuring 25 mm×90 mm is prepared, a 20 mm portion at one end in a longitudinal direction of the sample piece is held with a holding tool, the holding tool is slid and fixed so that the measuring portion of an U gauge located at a position 20 mm away from the holding tool should be contacted to the center of a 20 mm portion at the other end of the sample piece, and stress is read from a recording meter 5 minutes after fixing and calculated into stress per 1 cm of width as flexural resistance (softness). The obtained flexural resistance (softness) is expressed in the unit of g/cm.

(5) Compressive Stress

A sample piece measuring 25 mm×90 mm is prepared, bent at a position 30 mm from one end in a longitudinal direction and fixed between a plane table and the measuring table of an U gauge set at an interval of 20 mm, the measuring table of the U gauge is moved down in parallel to the plane table at a rate of 10 mm/min to compress the sample piece, and stress when the interval between the plane table and the U gauge becomes 5 mm is read with a recording meter and calculated into stress per 1 cm of width as compressive stress (tightness). The obtained compressive stress is expressed in the unit of g/cm.

(6) Leather Likeness

The characteristic features of natural leather are "softness and tightness" which are obtained by its fine and uniform structure. The leather likeness is expressed by (compressive stress)/(flexural resistance) as an index.

Example 1

Formation of Non-woven Fabric-1

A strippable and splittable composite fiber comprising polyethylene terephthalate as a first component and nylon-6 as a second component and having a 16-split gear type section as shown in FIG. 1 was melt spun at a take-up rate of 1,000 m/min to obtain unstretched fiber of 6.6 denier. The volume ratio of the both components was 50:50 and the both components were split into 16 parts in total by each other. After spinning, the unstretched fiber was drawn to 2.0 times in 40° C. hot water to obtain stretched fiber of 3.3 denier. Thereafter, a lubricant was applied to the stretched fiber in an amount of 0.3%, and the fiber was mechanically crimped by passing through a stuffing box, dried with a conveyor type hot air drier heated at 60° C., and cut to a fiber length of 45 mm to obtain a heat shrinkable strippable and splittable composite short fiber having a hot water shrinkage ratio of 9.5%.

Card webs obtained by opening the above heat shrinkable strippable and splittable composite short fiber with a parallel card were layered together with a cross layer to obtain a layered web having a weight of 180 $g/m^2$. This layered web was then subjected to needle punching with a needle loom having 77 needles/$cm^2$ and to an entangling treatment by contact with a jet liquid flow from the front side at a water pressure of 50 $kg/cm^2$ one time and at a water pressure of 140 $kg/cm^2$ two times consecutively, and from the back side at a water pressure of 140 $kg/cm^2$ two times to obtain a non-woven fabric having a weight of 165 $g/m^2$. The splitting rate of the fibers contained in the non-woven fabric was 95%. The splitting rate of the fibers in the non-woven fabric was a value obtained by taking a picture of the cross section of the non-woven fabric with an electron microscope at a magnification of 200X and dividing the difference between the whole area and the total cross section of unsplit fibers (including not completely split fibers, for example, fibers split into two or three parts) by the whole area. The larger the value the better the fiber is split.

The above non-woven fabric was immersed in a hot water tank heated at 75° C. for 20 seconds to shrink the polyethylene terephthalate fiber to reduce the area of the non-woven fabric by 21% and dried at 110° C. with a hot air drier to obtain non-woven fabric-1 having a thickness of 0.63 mm and an apparent density of 0.331 $g/cm^3$. The average monofilament size of this non-woven fabric-1 was 0.23 denier. When the sectional structure of the obtained non-woven fabric was analyzed by the image analysis of an electron scanning microscope, the average area of spaces between fibers was 223.3 $\mu m^2$ and the standard deviation was 474.5 $\mu m^2$. The image showed a fine and uniform structure.

Example 2

Formation of Non-woven Fabric-2

A heat shrinkable strippable and splittable composite short fiber of 4.5 denier having a hot water shrinkage ratio of 13.5% was obtained in the same manner as in Example 1 except that the fiber was stretched to 1.5 times in 60° C. hot water. Card webs obtained by opening the obtained fiber with a parallel card were layered together with a cross layer to obtain a layered web having a weight of 200 $g/m^2$. This layered web was then subjected to splitting and entangling treatments under the same conditions as in Example 1 to obtain a non-woven fabric having a weight of 188 $g/m^2$. The splitting rate of the fibers contained in the non-woven fabric was 96%. Thereafter, the above non-woven fabric was subjected to the same heat treatment as in Example 1 to reduce the area of the non-woven fabric by 23% to obtain non-woven fabric-2 having a thickness of 0.73 mm and an apparent density of 0.337 $g/cm^3$. The average monofilament size of this non-woven fabric-2 was 0.31 denier. When the sectional structure of the obtained non-woven fabric-2 was analyzed by the image analysis of an electron scanning microscope, the average area of spaces between fibers in the cross section of this non-woven fabric was 186.7 $\mu m^2$ and the standard deviation was 375.7 $\mu m^2$.

Example 3

Formation of Sheet-1

The non-woven fabric-1 prepared in Example 1 was impregnated with a 10% dimethylformamide solution of a polyurethane having a 100% elongation stress of 105 $kg/cm^3$ synthesized from diphenylmethane diisocyanate, polytetramethylene glycol, polyethylene adipate diol and ethylene glycol, an excess of the solution on the surface was scraped off, the non-woven fabric-1 was immersed in water to coagulate the polyurethane, washed and dried to obtain sheet-1. The obtained sheet-1 had a weight ratio of the non-woven fabric to the polyurethane of 77:23, a weight of 272 g/m$^2$, a thickness of 0.65 mm and an apparent density of 0.42 g/cm$^3$. The tensile strength was 11.5 kg/cm in a longitudinal direction and 9.2 kg/cm in a transverse direction, and the breaking elongation was 85% in a longitudinal direction and 110% in a transverse direction. When the sectional structure of the sheet-1 was analyzed by the image analysis of an electron scanning microscope, the average area of spaces in the cross section of the sheet-1 was 101.6 $\mu$m$^2$ and the standard deviation was 131.3 $\mu$m$^2$. The image showed an extremely fine and uniform structure.

Example 4

Formation of Sheet-2

The non-woven fabric-2 prepared in Example 2 was impregnated with a W/O type emulsion obtained by dispersing 35 parts of water in 100 parts of a 16% methyl ethyl ketone slurry solution of a polyurethane having a 100% elongation stress of 110 kg/cm$^3$ synthesized from diphenylmethane diisocyanate, polytetramethylene glycol, polyoxyethylene glycol, polybutylene adipate diol and trimethylene glycol, an excess of the emulsion solution on the surface was scraped off, the polyurethane was coagulated in an atmosphere of temperature of 45° C. and relative humidity of 70%, and the non-woven fabric-2 was dried to obtain sheet-2. The obtained sheet-2 had a weight ratio of the non-woven fabric to the polyurethane of 76:24, a weight of 331 g/m$^2$, a thickness of 0.74 mm and an apparent density of 0.45 g/cm$^3$. The tensile strength was 13.1 kg/cm in a longitudinal direction and 11.7 kg/cm in a transverse direction and the breaking elongation was 92% in a longitudinal direction and 115% in a transverse direction. When the sectional structure of the obtained sheet-2 was analyzed by the image analysis of an electron scanning microscope, the average area of spaces in the cross section of the sheet-2 was 89.2 $\mu$m$^2$ and the standard deviation was 115.0 $\mu$m$^2$. The image showed a fine and uniform structure.

Example 5

Formation of Artificial Leather-1

A 50 $\mu$m polyurethane film which was formed on release paper was bonded to the surface of the sheet-1 prepared in Example 3 with a two-liquid urethane-based adhesive, dried and fully crosslinked, and the release paper was stripped off to obtain grain type artificial leather-1. The obtained artificial leather had a weight of 345 g/m$^2$, a thickness of 0.71 mm, a flexural resistance of 0.35 g/cm, a compressive stress of 36 g/cm and a large leather likeness of 103 which falls within the range (90 to 130) of general calf, natural leather. This artificial leather was soft and very tight, was not wrinkled when its surface was bent inward but had an infinite number of fine wrinkles scattered all over the surface, gave a fine and uniform impression not attainable by conventional artificial leather, and was suitable for use as a material for shoes, sheets and gloves.

Example 6

Formation of Artificial Leather-2

A 50 $\mu$m polyurethane film which was formed on release paper was bonded to the surface of the sheet-2 prepared in Example 4 with a two-liquid urethane-based adhesive, dried and fully crosslinked, and the release paper was stripped off to obtain grain type artificial leather-2. The obtained artificial leather had a weight of 405 g/m$^2$, a thickness of 0.81 mm, a flexural resistance of 0.43 g/cm, a compressive stress of 48 g/cm and a large leather likeness of 113, was soft and very tight, hardly wrinkled by bending, gave a fine and uniform impression not attainable by conventional artificial leather, and was suitable for use as a material for shoes, sheets and gloves.

Example 7

Formation of Artificial Leather-3

A 18% dimethylformamide solution of the polyurethane used in Example 1 was coated on the surface of the sheet-1 prepared in Example 3 to a weight of 600 g/m$^2$, and the sheet obtained was immersed in water to coagulate the polyurethane, washed and dried to obtain an artificial leather substrate. The surface of the obtained artificial leather substrate was coated with a coloring coating containing a pigment with a gravure roll, heated and patterned with an embossing roll to obtain artificial leather-3. The obtained artificial leather had a weight of 380 g/m$^2$, a thickness of 0.85 mm, a flexural resistance of 0.52 g/cm, a compressive stress of 49 g/cm and a large leather likeness of 94. The surface of the artificial leather was soft, very tight and hardly wrinkled by bending and felt like high-grade calf natural leather.

Comparative Example 1

Formation of Non-woven Fabric-3

After spinning, a strippable and splittable composite short fiber having a fineness of 3.3 denier and a fiber length of 45 mm was obtained in the same manner as in Example 1 except the fiber was stretched to 2.0 times in 80° C. hot water. The hot water shrinkage ratio was 1.0%. Card webs obtained by opening the obtained fiber with a parallel card were layered together with a cross layer to obtain a layered web having a weight of 200 g/m$^2$. This layered web was then subjected to the same splitting and entangling treatments as in Example 1 to obtain a non-woven fabric having a weight of 192 g/m$^2$. The splitting rate of the fibers contained in the non-woven fabric was 94%. The non-woven fabric was then subjected to the same heat treatment as in Example 1 to obtain non-woven fabric-3 having an apparent density of 0.232 g/cm$^3$. The area shrinkage ratio at this point was 3%. The average monofilament size of the non-woven fabric-3 was 0.23 denier. When the sectional structure of the obtained non-woven fabric was analyzed by the image analysis of an electron scanning microscope, the average area of spaces between fibers was 297.5 $\mu$m$^2$ and the standard deviation was 642.2 $\mu$m$^2$. Although the structure looked fine at the first sight of the image, it was such a structure that large spaces were scattered and assemblies of stripped and split fibers having a small fineness were entangled with one another.

Comparative Example 2

Formation of Sheet-3

The non-woven fabric-3 prepared in Comparative Example 1 was impregnated with the polyurethane used in Example 3, coagulated, washed and dried with the same operation as in Example 3to obtain sheet-3. The obtained sheet-3 had a weight ratio of the non-woven fabric to the polyurethane of 79:21, a weight of 273 g/m$^2$, a thickness of 0.83 mm and an apparent density of 0.33 g/cm$^3$. The tensile strength was 12.1 kg/cm in a longitudinal direction and 9.6 kg/cm in a transverse direction and the breaking elongation was 82% in a longitudinal direction and 115% in a transverse direction. When the sectional structure of the sheet was analyzed by the image analysis of an electron scanning microscope, the average area of spaces in the cross section of the sheet was 185.1 $\mu$m$^2$and the standard deviation was 387.1 $\mu$m$^2$. The image showed that a great number of large spaces were formed and the structure was not fine and uniform.

Comparative Example 3

Formation of Artificial Leather-4

A polyurethane film was formed on the surface of the sheet-3 prepared in Comparative Example 2 with the same operation as in Example 5 using release paper to obtain grain type artificial leather-4. The obtained artificial leather-4 had a weight of 346 g/m$^2$, a thickness of 0.86 mm, a flexural resistance of 0.95 g/cm, a compressive stress of 34 g/cm and a leather likeness of 36. The grain type artificial leather-4 was greatly wrinkled when its surface was bent inward like a conventional grain type artificial leather.

Comparative Example 4

Formation of Non-woven Fabric-4

Card webs obtained by opening the heat shrinkable strippable and splittable composite short fiber prepared in Example 1 with a parallel card were layered together with a cross layer to obtain a layered web having a weight of 180 g/m$^2$. This layered web was then subjected to needling punching with a needle loom having 850 needles/cm$^2$ and immersed in an emulsion containing 15% of benzyl alcohol and 3% of a nonionic surfactant at 75° C. for 10 minutes and dried to obtain non-woven fabric-4 having a thickness of 0.70 mm and an apparent density of 0.33 g/cm$^3$. The obtained non-woven fabric-4 had an area shrinkage ratio of 29% and a splitting rate of 82% probably because stripping/splitting and shrinkage proceeded simultaneously. The non-woven fabric-4 had a structure that assemblies of stripped and split fibers remained entangled like before stripping/splitting. When the sectional structure of the non-woven fabric-4 was analyzed by the image analysis of an electron scanning microscope, the average area of spaces between fibers was 457 $\mu$m$^2$and the standard deviation was 891 $\mu$m$^2$. The image showed that assemblies of stripped and split fibers having a small fineness were entangled with one another and the structure looked fine as a whole but large spaces were scattered.

Comparative Example 5

Formation of Sheet-4

The non-woven fabric-4 prepared in Comparative Example 4 was impregnated with the polyurethane used in Example 3, coagulated, washed and dried with the same operation as in Example 3 to obtain sheet-4. The obtained sheet-4 had a weight ratio of the non-woven fabric to the polyurethane of 77:23, a weight of 302 g/m$^2$, a thickness of 0.70 mm and an apparent density of 0.43 g/cm$^3$. The tensile strength was 10.2 kg/cm in a longitudinal direction and 8.6 kg/cm in a transverse direction and the breaking elongation was 92% in a longitudinal direction and 117% in a transverse direction. When the sectional structure of the sheet-4 was analyzed by the image analysis of an electron scanning microscope, the average area of spaces in the cross section of the sheet-4 was 252.1 $\mu$m$^2$ and the standard deviation was 574.5 $\mu$m$^2$. The image showed that the structure looked fine and uniform at first sight but large spaces were scattered.

Comparative Example 6

Formation of Artificial Leather-5

A polyurethane film was formed on the surface of the sheet-4 prepared in Comparative Example 5 with the same operation as in Example 5 using release paper to obtain grain type artificial leather-5. The obtained artificial leather-5 had a weight of 375 g/m$^2$, a thickness of 0.73 mm, a flexural resistance of 0.62 g/cm, a compressive stress of 30 g/cm and a leather likeness of 48. The grain type artificial leather-5 was greatly wrinkled when its surface was bent inward like a conventional grain type artificial leather.

Comparative Example 7

Formation of Non-woven Fabric-5

Stretched fiber of a 5.5 denier composite fiber having a sea-island cross section was obtained by stretching a polymers-blended fiber formed from nylon-6 as an island component and polyethylene as a sea component (weight ratio of 50:50). Thereafter, a lubricant was applied to the fiber in an amount of 0.3%, and the fiber was mechanically crimped by passing through a stuffing box, dried with a hot air drier and cut to a length of 45 mm to obtain a sea-island type composite short fiber from the polymers-blended fiber. Card webs obtained by opening the fiber with a parallel card were layered together with a cross layer and subjected to needle punching with a needle loom having 800 needles/cm$^2$ to obtain a non-woven fabric having a weight of 500 g/m$^2$. The non-woven fabric was then subjected to a heat pressurizing treatment to obtain non-woven fabric-5 having a thickness of 1.47 mm and an apparent density of 0.34 g/cm$^3$. When the sectional structure of the obtained non-woven fabric-5 was analyzed by the image analysis of an electron scanning microscope, the average area of spaces between fibers was 768.5 $\mu$m$^2$ and the standard deviation was 1,219.2 $\mu$m$^2$. The image showed that large spaces were formed because of a large fineness of 5.5 denier. The non-woven fabric-5was immersed in toluene heated at 90° C. to dissolve and extract polyethylene forming the sea component of the composite fiber and fine fibers of the nylon-6 forming the island component were thereby formed and dried. However, the fibers adhered to one another because they were too fine and a 0.31 mm-thick paper-like product which could not be used as artificial leather was obtained. Therefore, the non-woven fabric-5 was used as artificial leather directly.

Comparative Example 8

Formation of Sheet-5

The non-woven fabric-5 prepared in Comparative Example 7 was impregnated with the polyurethane used in Example 3, coagulated, washed and dried with the same operation as in Example 3. The sheet obtained was immersed in toluene heated at 90° C. to dissolve and extract polyethylene forming the sea component of the composite fiber and fine fibers of the nylon-6 forming the island component were thereby formed and dried. Thereafter, sheet-5 was obtained by heat pressurizing treatment to adjust its thickness and apparent specific gravity. The obtained sheet-5 had a weight ratio of the non-woven fabric to the polyurethane of 59:41, a weight of 426 g/m$^2$, a thickness of 1.12 mm and an apparent density of 0.38 g/cm$^3$. The tensile strength was 12.4 kg/cm in a longitudinal direction and 11.4 kg/cm in a transverse direction and the breaking elongation was 96% in a longitudinal direction and 109% in a transverse direction. When the sectional structure of the sheet-5 was analyzed by the image analysis of an electron scanning microscope, the average area of spaces in the cross section of the sheet-5 was 297.6 $\mu$m$^2$ and the standard deviation was 795.4 m$^2$. The image showed such a structure that the polyurethane was existent while assemblies of fine fibers of 0.05 to 0.001 denier were entangled with one another and there were a great number of large spaces.

Comparative Example 9

Formation of Artificial Leather-6

A polyurethane film was formed on the surface of the sheet-5 prepared in Comparative Example 8 with the same operation as in Example 5 using release paper to obtain grain type artificial leather-6. The obtained artificial leather-6 had a weight of 497 g/m$^2$, a thickness of 1.21 mm, a flexural resistance of 0.53 g/cm, a compressive stress of 28 g/cm and a leather likeness of 53. The grain type artificial leather-6 was very soft but not tight and was greatly wrinkled when its surface was bent inward like a conventional grain type artificial leather.

Comparative Example 10

Formation of Sheet-6

The surface of the sheet-5 prepared in Comparative Example 8 was buffed with a buffing machine and raised so that the sheet obtained was covered with fine fibers having long hair and then this raised surface was subjected to an entangling treatment by contact with a jet liquid flow at a water pressure of 50 kg/cm$^2$ one time and at a water pressure of 140 kg/cm$^2$ two times to finely entangle the raised fine fibers on the surface again so as to obtain sheet-6. When the cross section of the sheet-6 was observed through an electron scanning microscope, most of it had such a structure that the polyurethane was existent while assemblies of fine fibers were entangled with one another like the sheet-5 but the fine and uniform structure that the fine fibers were entangled with one another which the present invention is directed to was obtained on the front side. However, according to the image analysis of the sheet-6, the average area of spaces in the cross section of the sheet-6 was 273.4 $\mu$m$^2$ and the standard deviation was 746.1 $\mu$m$^2$.

Comparative Example 11

Formation of Artificial Leather-7

A polyurethane film was formed on the raised and re-entangled surface of the sheet-6 prepared in Comparative Example 10 with the same operation as in Example 5 using release paper to obtain grain type artificial leather-7. The obtained artificial leather-7 had a weight of 481 g/m$^2$, a thickness of 1.16 mm, a flexural resistance of 0.52 g/cm, a compressive stress of 28 g/cm and a leather likeness of 54. The grain type artificial leather-7 was completely identical to the grain type artificial leather-6 except that it was superior in surface smoothness to the grain type artificial leather-6, was very soft but not tight and was greatly wrinkled when its surface was bent inward like a conventional grain type artificial leather.

Comparative Example 12

Formation of Non-woven Fabric-6

Stretched fiber of 5.3 denier was obtained by spinning polyethylene terephthalate as an island component and polyethylene as a sea component (weight ratio: 70:30) from a spinning nozzle so that 37 islands were existent in the cross section of the obtained fiber and stretching the fiber. Thereafter, a lubricant was applied to the fiber in an amount of 0.3%, and the fiber was mechanically crimped by passing through a stuffing box, dried with a hot air drier and cut to a length of 45 mm to obtain a sea-island type composite short fiber. Card webs obtained by opening the fiber with a parallel card were layered together with a cross layer and subjected to needle punching with a needle loom having 800 needles/cm$^2$ to obtain a non-woven fabric having a weight of 400 g/m$^2$. The non-woven fabric was then subjected to a heat pressurizing treatment to obtain non-woven fabric-6 having a thickness of 1.21 mm and an apparent density of 0.33 g/cm$^3$. When the sectional structure of the obtained non-woven fabric was analyzed by the image analysis of an electron scanning microscope, the average area of spaces between fibers was 729.5 $\mu$m$^2$ and the standard deviation was 1,179.1$\mu$m$^2$. The image showed that large spaces were formed due to a large fineness of 5.3 denier. The non-woven fabric-6 was immersed in toluene heated at 90° C. to dissolve and extract the polyethylene forming the sea component of the composite fiber and fine fibers of the polyethylene terephthalate forming the island component were thereby formed and dried. When the fineness of the fine fibers was measured, it was 0.14 denier. When the sectional structure of the non-woven fabric was analyzed by the image analysis of an electron scanning microscope, the average area of spaces between fibers was 647.6 $\mu$m$^2$ and the standard deviation was 1,059.5 $\mu$m$^2$. Large spaces were formed in the non-woven fabric formed of the fine fibers.

Comparative Example 13

Formation of Sheet-7

The non-woven fabric-6 prepared in Comparative Example 12 was impregnated with the polyurethane used in Example 3, coagulated, washed and dried with the same operation as in Example 3. Thereafter, the sheet obtained was immersed in toluene heated at 90° C. to dissolve and extract the polyethylene forming the sea component of the composite fiber and fine fibers of the polyethylene terephthalate forming the island component were thereby formed and dried. Thereafter, sheet-7 was obtained by adjusting its thickness and apparent specific gravity by heat pressurizing treatment. The obtained sheet-7 had a weight ratio of the non-woven fabric to the polyurethane of 58:42, a weight of 483 g/m$^2$, a thickness of 1.20 mm and an apparent density of 0.40 g/cm$^3$. The tensile strength was 13.2 kg/cm in a longitudinal direction and 11.9 kg/cm in a transverse direction and the breaking elongation was 89% in a longitudinal direction and 102% in a transverse direction. When the sectional structure of the sheet-7 was analyzed by the image analysis of an electron scanning microscope, the average area of spaces between fibers in the cross section of the sheet-7 was 256.2 $\mu$m$^2$ and the standard deviation was 728.6 $\mu$m$^2$. The image showed such a structure that the polyurethane was existent while assemblies of fine fibers of about 0.1 denier were entangled with each other and there were a great number of large spaces.

Comparative Example 14

Formation of Artificial Leather-8

A polyurethane film was formed on the surface of the sheet-7 prepared in Comparative Example 13 with the same operation as in Example 5 using release paper to obtain grain type artificial leather-8. The obtained artificial leather-8 had a weight of 522 g/m$^2$, a thickness of 1.25 mm, a flexural resistance of 0.59 g/cm, a compressive stress of 28 g/cm and a leather likeness of 47. The grain type artificial leather-8 was very soft but not tight and greatly wrinkled when its surface was bent inward like a conventional grain type artificial leather.

The above results are shown in Table 1 and Table 2.

Examples A to C in Table 1 and Comparative Examples A to E in Table 2 are combinations of non-woven fabrics from fine fiber, sheets and artificial leathers produced in Examples and Comparative Examples respectively.

TABLE 1

| type | property values | Example A | Example B | Example C |
|---|---|---|---|---|
| non-woven | | Example 1 | Example 1 | Example 2 |
| fabric | S% | 21 | 21 | 23 |
| | h | 0.63 | 0.63 | 0.73 |
| | ρ | 0.33 | 0.33 | 0.34 |
| | s | 223.3 | 223.3 | 186.7 |
| | σ | 474.5 | 474.5 | 375.7 |
| sheet | | Example 3 | Example 3 | Example 4 |
| | F:R | 77:23 | 77:23 | 74:26 |
| | W | 272 | 272 | 331 |
| | h | 0.65 | 0.65 | 0.74 |
| | ρ | 0.42 | 0.42 | 0.45 |
| | s | 101.6 | 101.6 | 89.2 |
| | σ | 131.3 | 131.3 | 115.0 |
| artificial | | Example 5 | Example 7 | Example 6 |
| leather | W | 345 | 380 | 405 |
| | h | 0.71 | 0.85 | 0.81 |
| | Rb | 0.35 | 0.52 | 0.43 |
| | P5 | 36 | 49 | 48 |
| | P5/Rb | 103 | 94 | 112 |

abbreviations
S%: area shrinkage ratio
h: thickness (mm)
ρ: apparent density (g/m$^2$)
s: average area of spaces in cross section ($\mu$m$^2$)
σ: standard deviation of area of space in cross section ($\mu$m$^2$)
W: weight (g/m$^2$)
Rb: flexural resistance (g/cm)
P5: compressive stress (g/cm)
P5/Rb: leather likeness

TABLE 2

| type | property values | Comp. Ex. A | Comp. Ex. B | Comp. Ex. C | Comp. Ex. D | Comp. Ex. E |
|---|---|---|---|---|---|---|
| non-woven fabric | | Comp. Ex. 1 | Comp. Ex. 4 | Comp. Ex. 7 | Comp. Ex. 7 | Comp. Ex. 12 |
| | S% | 3 | 29 | — | — | — |
| | h | 0.84 | 0.70 | 1.47 | 1.47 | 1.21 |
| | ρ | 0.23 | 0.33 | 0.34 | 0.34 | 0.33 |
| | s | 297.5 | 457 | 768.5 | 768.5 | 729.5 |
| | σ | 642.2 | 891 | 1219.2 | 1219.2 | 1179.1 |

TABLE 2-continued

| type | property values | Comp. Ex. A | Comp. Ex. B | Comp. Ex. C | Comp. Ex. D | Comp. Ex. E |
|---|---|---|---|---|---|---|
| sheet | | Comp. Ex. 2 | Comp. Ex. 5 | Comp. Ex. 8 | Comp. Ex. 10 | Comp. Ex. 13 |
| | F:R | 79:21 | 77:23 | 59:41 | — | 70:30 |
| | | Ex. 14 | | | | |
| | W | 346 | 375 | 497 | 481 | 552 |
| | h | 0.86 | 0.73 | 1.21 | 1.16 | 1.25 |
| | Rb | 0.95 | 0.62 | 0.53 | 0.52 | 0.59 |
| | P5 | 34 | 30 | 28 | 28 | 28 |
| | P5/Rb | 36 | 48 | 53 | 54 | 47 |

Ex.: Example
Comp. Ex.: Comparative Example
abbreviations:
same as in Table 1

As is obvious from comparison between Table 1 and Table 2, even when non-woven fabrics formed by the entanglement of assemblies of fine fibers, such as non-woven fabrics formed of fine fibers produced from a two or more component strippable and splittable composite short fiber and obtained by shrinking the strippable and splittable short fiber before it is completely stripped and split (Comparative Example 1, Comparative Example 4), non-woven fabrics formed of fine fibers produced from a sea-island type composite short fiber and obtained by shrinking the formed non-woven fabrics through a heat pressurizing treatment (Comparative Example 7, Comparative Example 12) and sheets obtained by forming non-woven fabrics formed of fine fibers composed of only island components by excluding the sea component from each of the above non-woven fabrics and shrinking the non-woven fabrics through a heat pressurizing treatment (Comparative Example 8, Comparative Example 13), are shrunk by heating, the average area of spaces and the standard deviation in the cross section of each of the above non-woven fabrics and sheets obtained therefrom do not satisfy conditions specified by the present invention. A non-woven fabric having a uniform and fine structure which the present invention is directed to is not obtained.

Example 8

Formation of Sheet-8

The non-woven fabric before a heat treatment in Example 2 was impregnated with the polyurethane used in Example 4, coagulated and dried at 80° C. with the same operation as in Example 4 to obtain sheet-8. The area shrinkage ratio of the obtained sheet-8 in the above impregnation, coagulation and drying steps was 15%. The obtained sheet-8 had a weight ratio of the non-woven fabric to the polyurethane of 69:31, a weight of 329 g/m$^2$, a thickness of 0.80 mm and an apparent density of 0.41 g/cm$^3$. The tensile strength was 12.2 kg/cm in a longitudinal direction and 10.3 kg/cm in a transverse direction and the breaking elongation was 98% in a longitudinal direction and 122% in a transverse direction. When the sectional structure of the sheet-8 was analyzed by the image analysis of an electron scanning microscope, the average area of spaces in the cross section of the sheet-8 was 117.4 $\mu$m$^2$ and the standard deviation was 230.0 $\mu$m$^2$. The image showed a very fine and uniform structure.

Example 9

Formation of Artificial Leather-9

A polyurethane film was formed on the surface of the sheet-8 prepared in Example 8 with the same operation as in Example 5 using release paper to obtain grain type artificial leather-9. The obtained artificial leather-9 had a weight of 402 g/m$^2$, a thickness of 0.86 mm, a flexural resistance of 0.53 g/cm, a compressive stress of 54 g/cm and a large leather likeness of 102, was soft and tight, hardly wrinkled by bending, gave a fine and uniform impression not attainable by a conventional artificial leather and was suitable for use as a material for shoes, sheets and gloves.

Comparative Example 15

Formation of Sheet-9

The non-woven fabric before a heat treatment in Comparative Example 1 was impregnated with the polyurethane used in Example 4, coagulated and dried at 80° C. with the same operation as in Example 4 to obtain sheet-9. The area shrinkage ratio of the obtained sheet-9 in the above impregnation, coagulation and drying steps was 1%. The obtained sheet-9 had a weight ratio of the non-woven fabric to the polyurethane of 70:30, a weight of 284 g/m$^2$, a thickness of 0.75 mm and an apparent density of 0.38 g/cm$^3$. The tensile strength was 14.4 kg/cm in a longitudinal direction and 12.5 kg/cm in a transverse direction and the breaking elongation was 83% in a longitudinal direction and 104% in a transverse direction. When the sectional structure of the sheet-9 was analyzed by the image analysis of an electron scanning microscope, the average area of spaces in the cross section of the sheet-9 was 185.1 $\mu$m$^2$ and the standard deviation was 387.1 $\mu$m$^2$. The image showed that the structure was not fine and uniform with a great number of large spaces.

Comparative Example 16

Formation of Artificial Leather-10

A polyurethane film was formed on the surface of the sheet-9 prepared in Comparative Example 15 with the same operation as in Example 5 using release paper to obtain grain type artificial leather-10. The obtained artificial leather-10 had a weight of 352 g/m$^2$, a thickness of 0.82 mm, a flexural resistance of 0.74 g/cm, a compressive stress of 32 g/cm and a leather likeness of 43. The grain type artificial leather-10 was greatly wrinkled when its surface was bent inward like a conventional grain type artificial leather.

EFFECT OF THE INVENTION

The non-woven fabric of the present invention is a non-woven fabric formed of fine fibers which satisfies the following requirements:

(i) the fine fibers should be obtained by splitting a strippable and splittable composite short fiber comprising at least two resin components which are incompatible with each other;

(ii) the fine fibers should have a monofilament size of 0.01 to 0.5 denier;

(iii) the fine fibers should form a fine non-woven fabric structure that they are entangled with one another at random;

(iv) the apparent density should be 0.18 to 0.45 g/cm$^3$;

(v) the average area of spaces between fibers in the cross section of the non-woven fabric measured by the image analysis of an electron scanning microscope should be 70 to 250 $\mu$m$^2$; and (vi) the non-woven fabric should have such a uniform structure that the standard deviation of the area of a space between fibers in the cross section of the non-woven fabric measured by the image analysis of the electron scanning microscope is 200 to 600 $\mu$m$^2$.

This non-woven fabric has an extremely fine, uniform and microscopic fiber space structure. Thus, the non-woven fabric or a sheet obtained by impregnating the non-woven fabric with an elastic polymer can be formed into artificial leather which is soft and tight and has a fine structure with a small number of bending wrinkles or a grain type artificial leather.

BRIEF DESCRIPTION OF DRAWING

FIG. 1 is an enlarged view of the cross section of the heat shrinkable strippable and splittable composite short fiber of the present invention.

Explanations of Notations 1 first component 2 second component

What is claimed is:

1. A non-woven fabric formed of fine fibers which satisfies the following requirements:

(i) the fine fibers are obtained by separating at least two resin components in a fine fiber which are incompatible with each other, wherein at least one of the resin components is separated into two or more of the fine fibers;

(ii) the fine fibers have a monofilament size of 0.01 to 0.5 denier;

(iii) the fine fibers form a fine non-woven fabric structure such that they are entangled with one another at random;

(iv) the apparent density is 0.18 to 0.45 g/cm$^3$;

(v) the average area of spaces between fibers in a cross section of the non-woven fabric measured by image analysis of an electron scanning microscope is 70 to 250 $\mu$m$^2$; and (vi) the non-woven fabric has such a uniform structure that a standard deviation of the area of a space between fibers in the cross section of the non-woven fabric measured by the image analysis of the electron scanning microscope is 200 to 600 $\mu$m$^2$.

2. The non-woven fabric of claim 1, wherein the at least two resin components in the fine fiber comprise a polyester component and a polyamide component.

3. The non-woven fabric of claim 1 which has an apparent density of 0.25 to 0.40 g/cm$^3$.

4. A sheet obtained by impregnating a non-woven fabric formed of fine fibers with an elastic polymer which satisfies the following requirements:

(i) the fine fibers are obtained by separating at least two resin components in a fine fiber which are incompatible with each other, wherein at least one of the resin components is separated into two or more of the fine fibers;

(ii) the fine fibers have a monofilament size of 0.01 to 0.5 denier;

(iii) the fine fibers form a fine non-woven fabric structure such that they are entangled with one another at random;

(iv) the sheet has a weight ratio of the non-woven fabric to the elastic polymer of 97:3 to 50:50;

(v) the sheet has an apparent density of 0.20 to 0.60 g/cm$^3$;

(vi) the sheet has an average area of spaces between fibers in a cross section of the non-woven fabric impregnated with the elastic polymer measured by image analysis of an electron scanning microscope of 70 to 120 $\mu m^2$; and (vii) the sheet has such a uniform structure that a standard deviation of the area of a space between fibers in the cross section of the non-woven fabric impregnated with the elastic polymer measured by the image analysis of the electron scanning microscope is 50 to 250 $\mu m^2$.

5. The sheet of claim 4 wherein the at least two components in the fine fiber comprise a polyester component and a polyamide component.

6. The sheet of claim 4 which has a weight ratio of the non-woven fabric to the elastic polymer of 95:5 to 60:40.

7. The sheet of claim 4, wherein the elastic polymer is a polyurethane.

8. The sheet of claim 4 which has an apparent density of 0.25 to 0.55 $g/cm^3$.

9. The sheet of claim 4 which has a thickness of 0.3 to 3.0 mm.

10. Artificial leather comprising the non-woven fabric of claim 1 as a substrate.

11. Artificial leather comprising the sheet of claim 4 as a substrate.

12. The artificial leather of claim 10 which has a grain pattern.

13. The artificial leather of claim 11 which has a grain pattern.

14. A shoe, ball, furniture sheet, car sheet, garment, glove, trunk or bag produced from the artificial leather of any one of claims 10 to 13.

* * * * *